US009580666B2

(12) United States Patent
Kubo et al.

(10) Patent No.: US 9,580,666 B2
(45) Date of Patent: Feb. 28, 2017

(54) LUBRICATING OIL COMPOSITION

(71) Applicant: SHELL OIL COMPANY, Houston, TX (US)

(72) Inventors: Kouichi Kubo, Kanagawa Aikou (JP); Kiyoshi Hanyuda, Kanagawa Aikou (JP)

(73) Assignee: SHELL OIL COMPANY, Houston, TX (US)

( * ) Notice: Subject to any disclaimer, the term of this patent is extended or adjusted under 35 U.S.C. 154(b) by 59 days.

(21) Appl. No.: 14/362,983

(22) PCT Filed: Dec. 7, 2012

(86) PCT No.: PCT/EP2012/074820

§ 371 (c)(1),
(2) Date: Jun. 5, 2014

(87) PCT Pub. No.: WO2013/083791

PCT Pub. Date: Jun. 13, 2013

(65) Prior Publication Data

US 2014/0342958 A1 Nov. 20, 2014

(30) Foreign Application Priority Data

Dec. 7, 2011 (JP) ..... 2011-268417

(51) Int. Cl.

| | |
|---|---|
| ***C10M 141/08*** | (2006.01) |
| ***C10M 169/04*** | (2006.01) |
| *C10M 133/06* | (2006.01) |
| *C10M 135/18* | (2006.01) |

(52) U.S. Cl.

CPC ..... *C10M 141/08* (2013.01); *C10M 169/04* (2013.01); *C10M 133/06* (2013.01); *C10M 135/18* (2013.01); *C10M 2203/1006* (2013.01); *C10M 2203/108* (2013.01); *C10M 2203/1025* (2013.01); *C10M 2205/022* (2013.01); *C10M 2205/0285* (2013.01); *C10M 2207/2805* (2013.01); *C10M 2215/04* (2013.01); *C10M 2215/06* (2013.01); *C10M 2215/064* (2013.01); *C10M 2215/28* (2013.01); *C10M 2219/066* (2013.01); *C10M 2219/068* (2013.01); *C10M 2223/045* (2013.01); *C10M 2229/041* (2013.01); *C10N 2220/022* (2013.01); *C10N 2230/02* (2013.01); *C10N 2230/06* (2013.01); *C10N 2230/54* (2013.01); *C10N 2230/74* (2013.01); *C10N 2240/10* (2013.01); *C10N 2240/104* (2013.01)

(58) Field of Classification Search

CPC ..... C10M 169/04; C10M 141/08

See application file for complete search history.

(56) References Cited

U.S. PATENT DOCUMENTS

| | | | | |
|---|---|---|---|---|
| 2,758,086 A * | 8/1956 | Stuart | ..... | C10M 1/08 106/14.26 |
| 4,769,178 A | 9/1988 | Kenmochi et al. | | |
| 5,922,654 A * | 7/1999 | Yamazaki | ..... | C10M 129/34 508/272 |

FOREIGN PATENT DOCUMENTS

| | | |
|---|---|---|
| CN | 86101764 | 3/1989 |
| EP | 0768366 | 4/1997 |
| EP | 1013749 | 6/2000 |
| JP | H08253785 | 8/1996 |
| JP | H09104888 | 9/1997 |
| JP | H10121079 | 10/1998 |
| JP | 2002371292 | 12/2002 |
| JP | 2004149762 | 5/2004 |
| JP | 2005041998 | 2/2005 |
| JP | 2005146010 | 6/2005 |
| WO | WO2012126985 * | 9/2012 |

OTHER PUBLICATIONS

TS8219-CN-PCT, State Intellectual Property Office of the People's Republic of China, Search Report, Office Action issued Feb. 12, 2015 by Chinese Patent Office, for Application No. 201280065889.0.

* cited by examiner

*Primary Examiner* — Cephia D Toomer

(57) ABSTRACT

A lubricating oil composition comprising (A) a lubricating oil base oil the kinematic viscosity of which at 100° C. is in the range of from 1.4 to 6 $mm^2/s$, (B) from 250 to 2000 ppm in terms of molybdenum of a molybdenum dialkyldithiocarbamate, (C) from 20 to 500 ppm in terms of sulphur of tetrabenzyl thiuram disulphide and (D) from 0.05 to 3.0 mass % of an amine. The lubricating oil composition of the present invention has a superior friction reducing effect and which has a superior fuel economy effect.

17 Claims, No Drawings

LUBRICATING OIL COMPOSITION

PRIORITY CLAIM

The present application is the National Stage (§371) of International Application No. PCT/EP2012/074820, filed Dec. 7, 2012, which claims priority from Japanese application no. 2011-268417, filed Dec. 7, 2011, the disclosures of which are incorporated herein by reference.

FIELD OF THE INVENTION

This invention relates to a lubricating oil composition. More specifically, it relates to a lubricating oil composition which has a superior friction reducing effect and which has a superior fuel economy effect.

BACKGROUND OF THE INVENTION

In recent years, there have been many attempts to tackle environmental problems such as global warming, and there has also been demand for engine oils (lubricating oil compositions) to show a fuel economy effect. For instance, low viscosity lubricating oil compositions have been discovered in which the friction coefficient in the boundary lubrication domain is reduced by blending in organic molybdenum compounds (for example, see Japanese Laid-open Patent 2002-371292). Also, low viscosity lubrication oil compositions have been discovered in which the friction coefficient in the boundary lubrication domain is reduced by blending in organic molybdenum compounds and further in which a fuel economy effect is exhibited even in the hydrodynamic lubrication domain by blending in a lubricating oil base oil based on specific esters (for example, see Japanese Laid-open Patent 2005-041998).

Furthermore, low viscosity lubrication oils have been discovered in which it has been possible to exhibit a superior fuel economy effect even without blending in organic molybdenum compounds, by blending in combinations of specific anti-oxidants (for example, see Japanese Laid-open Patent 2005-146010). Also, as examples of commercial engine oils sold as fuel economising oils, mention may be made of low viscosity oils such as SAE viscosity grades 5W-30, 5W-20 and 0W-20 and low viscosity oils blended with organic molybdenum compounds.

Apart from these, lubricating oil compositions have been disclosed which, as well as containing organic molybdenum compounds, are blended so that a sulphur component is offered (for example, see Japanese Laid-open Patent H08-253785 (1996), Japanese Laid-open Patent 2004-149762 and Japanese Laid-open Patent H09-104888 (1997)). Lubricating oil compositions have also been disclosed which contain molybdenum compounds and dithiocarbamates (thiocarbamoyl compounds) (for example, see Japanese Laid-open Patent H10-121079 (1998) and Japanese Laid-open Patent H10-130680 (1998)).

Organic molybdenum compounds are chiefly categorised as three types: the so-called molybdenum dialkyldithiophosphates (which may be referred to below as MoDTPs), the so-called molybdenum dialkyldithiocarbamates (which may be referred to below as MoDTPs), and those which are compounds in which the molybdenum becomes an amine complex. Recently, MoDTPs, because they contain the element phosphorus, have hardly been used in lubricating oils for internal combustion engines. This is because, if engine oils with MoDTPs added are used in actual engine oils, whenever trace amounts of engine oil enter the combustion chamber via compression rings or via engine valves and are burnt together with the fuel, exhaust gases containing elemental phosphorus derived from the MoDTPs are emitted, and there is concern that they will have a detrimental effect on the apparatus for treating the emissions and on the life of the catalyst.

On the other hand, MoDTCs do not contain phosphorus, and so are used as friction modifiers in lubricating oils for internal combustion engines. It is known that MoDTCs form a film on the sliding friction surfaces inside the engine and said film contains "molybdenum disulphide" compounds in which the elemental composition ratio is close to molybdenum disulphide. MoDTCs contain sulphur and molybdenum in their molecules and so they break down on a sliding friction surface and a film containing molybdenum disulphide compounds is formed. These molybdenum disulphide compounds are believed to reduce friction.

MoDTCs contain sulphur and molybdenum in their molecules, but the amount of sulphur relative to the amount of molybdenum is comparatively small, and so it has not been easy to form the molybdenum disulphide compounds satisfactorily with the MoDTCs alone. In order to enhance the activity of film formation (formation of the molybdenum disulphide compounds), it has been necessary to increase the sulphur component. For this reason, a sulphur component has been supplied from outside (for example, see Japanese Laid-open Patent H08-253785 (1996), Japanese Laid-open Patent 2004-149762 and Japanese Laid-open Patent H09-104888 (1997)). However, increasing the sulphur component is not desirable, because it accelerates clogging of the emissions treatment apparatus and poisoning of the catalyst. As far as practicable, it is necessary to obtain a bigger friction reducing effect by reducing the supply of a sulphur component from outside.

Likewise, compounds in which molybdenum has formed an amine complex do not have sulphur in their molecules, and so find it difficult to create molybdenum disulphide compounds beyond the MoDTCs. For this reason, the friction reducing effect becomes extremely small. In the case of amine complexes, therefore, it has been absolutely necessary to supply a sulphur component from outside.

This invention has been made in consideration of the aforesaid problems. The aim has been to minimise the effects on emission treatment apparatus and catalysts by reducing as far as practicable the amounts of MoDTCs and sulphur compounds contained, and so to offer, even where these may still be present in trace amounts, a lubricating oil composition which has a superior friction reducing effect over a long period and which has a high degree of fuel economy.

SUMMARY OF THE INVENTION

According to the present invention, there is provided a lubricating oil composition, comprising (A) a lubricating oil base oil the kinematic viscosity of which at 100° C. is in the range of from 1.4 to 6 $mm^2/s$, (B) from 250 to 2000 ppm in terms of molybdenum of a molybdenum dialkyldithiocarbamate as expressed by the undermentioned Formula (1), (C) from 20 to 500 ppm in terms of sulphur of tetrabenzyl thiuram disulphide as expressed by the undermentioned Formula (2) and (D) from 0.05 to 3.0 mass % of an amine as expressed by the undermentioned Formula (3) or Formula (4).

Chemical Formula 1

(1)

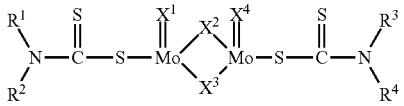

(In Formula (1), $R^1$ to $R^4$ denote alkyl groups, and $X^1$ to $X^4$ denote oxygen atoms or sulphur atoms.)

Chemical Formula 2

(2)

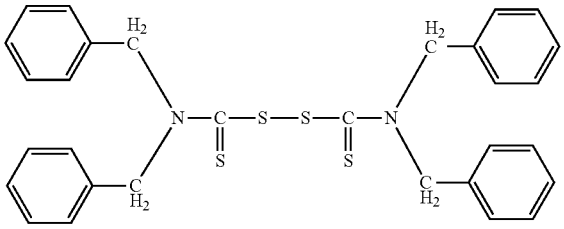

Chemical Formula 3

(3)

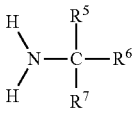

(In Formula (3), $R^5$ to $R^7$ denote, each independently, hydrogen or an "alkyl group, aryl group or alkylaryl group" having from 1 to 23 carbon atoms.)

[Chemical Formula 4

(4)

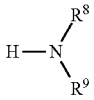

(In Formula (4), $R^8$ and $R^9$ denote, each independently, hydrogen or an "alkyl group, aryl group or alkylaryl group" having from 1 to 23 carbon atoms).

The lubricating oil composition of this invention contains (B) from 250 to 2000 ppm in terms of molybdenum of a molybdenum dialkyldithiocarbamate as expressed by the aforementioned Formula (1), (C) from 20 to 500 ppm in terms of sulphur of tetrabenzyl thiuram disulphide as expressed by the aforementioned Formula (2) and (D) from 0.05 to 3.0 mass % of an amine as expressed by the aforementioned Formula (3) or Formula (4), so that, as well as molybdenum being supplied from the molybdenum dialkyldithiocarbamate, a sulphur component is supplied through breakdown of the tetrabenzyl thiuram disulphide and so it becomes possible to form a film on sliding friction surfaces inside the engine by means of molybdenum disulphide compounds. Furthermore, because the tetrabenzyl thiuram disulphide has a high thermal decomposition temperature, it remains for long periods within the lubricating oil composition, only breaking down little by little even inside the engine. Because of this, it is possible over long periods to prevent losses of the sulphur within the lubricating oil composition, and it becomes possible to form a film by means of molybdenum disulphide compounds continuously. This also means it is possible to exhibit a superior friction reducing effect and a superior fuel economy effect. In addition, the lubricating oil composition of this invention contains (D) from 0.05 to 3.0 mass % of an amine as expressed by the aforementioned Formula (3) or Formula (4), and so the tetrabenzyl thiuram disulphide, which is difficult to dissolve in the lubricating oil base oil, becomes easy to dissolve readily in the lubricating oil base oil. This means that the aforementioned function of the tetrabenzyl thiuram disulphide as expressed by the aforementioned Formula (2) is exhibited more effectively.

DETAILED DESCRIPTION OF THE INVENTION

A form of embodiment of the invention is next explained in detail, but the invention is not limited to the following form of embodiment, and so long as there is no divergence from the essentials of the invention it must be understood that modifications and improvements of suitable designs may be made on the basis of the usual knowledge of those skilled in the art.

(1) Lubricating Oil Composition:

One form of embodiment of the lubricating oil composition of this invention is a lubricating oil composition which contains (A) a lubricating oil base oil the kinematic viscosity of which at 100° C. is in the range of from 1.4 to 6 $mm^2/s$ (which may be referred to below as "constituent (A)"), (B) from 250 to 2000 ppm in terms of molybdenum of a molybdenum dialkyldithiocarbamate as expressed by the undermentioned Formula (1) (which may be referred to below as "constituent (B)"), (C) from 20 to 500 ppm in terms of sulphur of tetrabenzyl thiuram disulphide as expressed by the undermentioned Formula (2) (which may be referred to below as "constituent (C)") and (D) from 0.05 to 3.0 mass % of an amine as expressed by the undermentioned Formula (3) or Formula (4) (which may be referred to below as "constituent (D)"). Units "ppm" are based on mass.

Chemical Formula 1

(1)

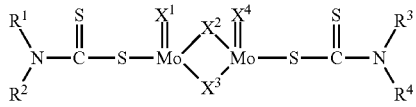

(In Formula (1), $R^1$ to $R^4$ denote alkyl groups, and $X^1$ to $X^4$ denote oxygen atoms or sulphur atoms.)

Chemical Formula 2

(2)

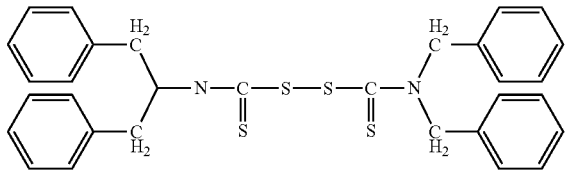

Chemical Formula 3

(3)

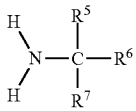

(In Formula (3), $R^5$ to $R^7$ denote, each independently, hydrogen or an "alkyl group, aryl group or alkylaryl group" having from 1 to 23 carbon atoms.)

Chemical Formula 4

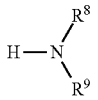

(4)

(In Formula (4), $R^8$ and $R^9$ denote, each independently, hydrogen or an "alkyl group, aryl group or alkylaryl group" having from 1 to 23 carbon atoms.)

Because the lubricating oil composition of this form of embodiment thus contains constituent (B) and constituent (C), as well as molybdenum being supplied from the molybdenum dialkyldithiocarbamate a sulphur component is supplied through breakdown of the tetrabenzyl thiuram disulphide and so it becomes possible to form a film on sliding friction surfaces inside the engine by means of molybdenum disulphide compounds. Furthermore, because the tetrabenzyl thiuram disulphide has a high thermal decomposition temperature, it remains for long periods within the lubricating oil composition, only breaking down little by little even inside the engine. Because of this, it is possible over long periods to prevent losses of the sulphur within the lubricating oil composition, and it becomes possible to form a film by means of molybdenum disulphide compounds continuously. This also means it is possible to exhibit a superior friction reducing effect and a superior fuel economy effect. In addition, the lubricating oil composition of this invention contains constituent (D), and so the tetrabenzyl thiuram disulphide, which is difficult to dissolve in the lubricating oil base oil, becomes easy to dissolve readily in the lubricating oil base oil. This means that the aforementioned function of constituent (C) is exhibited more effectively.

(1-1) Constituent A:

Constituent (A) is a lubricating oil base oil the kinematic viscosity of which at 100° C. is in the range of from 1.4 to 6 $mm^2/s$. The kinematic viscosity at 100° C. is preferably in the range of from 1.4 to 5.0 $mm^2/s$ and more preferably in the range of from 1.4 to 3.5 $mm^2/s$. If the kinematic viscosity at 100° C. is lower than 1.4 $mm^2/s$, the amount of evaporation when running at high temperatures becomes large, which is not desirable. If the kinematic viscosity at 100° C. is higher than 6 $mm^2/s$, the fuel economy effect decreases, which is not desirable. The kinematic viscosity is the value determined by the method in accordance with JIS K 2283.

Constituent (A) is preferably one which contains at least one kind selected from a group comprised of (A1) mixed mineral oil base oils the kinematic viscosity of which at 100° C. is in the range of from 1.4 to 6 $mm^2/s$ (which may be referred to below as "constituent (A1)"), (A2) polyalphaolefins, alphaolefin oligomers or mixtures thereof the kinematic viscosity of which at 100° C. is in the range of from 2 to 8 $mm^2/s$ (which may be referred to below as "constituent (A2)"), (A3) hindered esters, diesters or mixtures thereof the kinematic viscosity of which at 100° C. is in the range of from 1.4 to 12 $mm^2/s$ (which may be referred to below as "constituent (A3)") and (A4) lubricating oil base oils the kinematic viscosity of which at 100° C. is 7 to 50 $mm^2/s$ (which may be referred to below as "constituent (A4)"). The polyalphaolefins and alphaolefin oligomers may each be one kind alone or may be mixtures of plural kinds.

The lubricating oil base oil used in the lubricating oil composition of the present form of embodiment (constituent (A)) preferably uses the following base oils (A1) to (A4), alone or, if necessary, as mixtures.

(1-1-1) Constituent (A1):

As mentioned above, constituent (A1) is a mixed mineral oil base oil the kinematic viscosity of which at 100° C. is in the range of from 1.4 to 6 $mm^2/s$. Specifically, it is a Group II base oil, a Group III base oil or a mixture of a Group II base oil and a Group III base oil. "Group II" and "Group III" here are categories for base oils as stipulated by the API (American Petroleum Institute).

As examples of Group II base oils mention may be made of paraffinic mineral oils obtained by application of a suitable combination of refining procedures such as hydrocracking and dewaxing on lubricating oil fractions obtained by vacuum distillation of crude oil. Group II base oils refined by hydrorefining methods such as the Gulf method, as well as having a total sulphur content of less than 10 ppm, have an aromatic component of not more than 5% and are ideal for possible use as base oils blended in the lubricating oil composition of this form of embodiment. Group II base oils where the viscosity index is "100 or more but less than 120" are preferred, but "105 or more but less than 120" is more preferred. Group II base oils where the total sulphur content is less than 300 ppm are preferred, and less than 100 ppm is more preferred, whilst less than 10 ppm is especially preferred. Group II base oils where the total nitrogen content is less than 10 ppm are preferred, and less than 1 ppm is more preferred. Group II base oils where the aniline point is 80 to 150° C. are preferred, and 100 to 135° C. is more preferred. The sulphur content is the value determined by using the x-ray fluorescence technique (ASTM D4294 and JIS K2541-4). The nitrogen content is the value determined by means of the chemiluminescence method of JIS K 2609 (Crude Petroleum and Petroleum Products—Determination of Nitrogen Content).

As examples of Group III base oils mention may be made of "paraffinic mineral oils obtained by application of severe hydrorefining measures on lubricating oil fractions obtained by vacuum distillation of crude oil", "base oils in which GTL (gas to liquid) waxes synthesised by the Fischer-Tropsch process, which is a technique for making liquefied fuels from natural gas, or waxes formed through further dewaxing processes" are "refined by the Isodewaxing process which is a dewaxing process involving first solvent dewaxing then converting to isoparaffins" and "base oils refined by the Mobil Wax isomerisation process". The viscosity index of Group III base oils is at least 120, and is preferably 120 to 150. Also, the total sulphur content of Group III base oils is preferably less than 100 ppm, but is more preferably less than 10 ppm. The total nitrogen content of Group II base oils is also preferably less than 10 ppm, but is more preferably less than 1 ppm. The aniline point of Group III base oils is preferably 80 to 150° C., but is more preferably 110 to 135° C.

(1-1-2) Constituent (A2):

Constituent (A2) is a base oil the kinematic viscosity of which at 100° C. is in the range of from 2 to 8 $mm^2/s$, and is a polyalphaolefin, an alphaolefin oligomer (α-olefin oligomer) or a mixture (polyalphaolefin and alphaolefin oligomer) thereof. Polyalphaolefins are polymers of alphaolefins (monomers) of various kinds. The polyalphaolefins may also be mixtures of a plurality of kinds of "polymers of alphaolefins (monomers)". Alphaolefin oligomers are oligomers of alphaolefins (monomers) of various kinds, and include also oligomers of hydrogenated alphaolefins (monomers). The alphaolefin oligomers may also be mixtures of a plurality of kinds of "oligomers of alphaolefins". They may also be mixtures in which a plurality of "oligomers of hydrogenated alphaolefins (monomers)" have been mixed together. The alphaolefin oligomers may also be mixtures of "oligomers of alphaolefins (monomers)" and "oligomers of hydrogenated alphaolefins (monomers)".

There is no special restriction on the alphaolefins (monomers), and mention may be made for example of ethylene, propylene, butene and alphaolefins with 5 or more carbons. In the manufacture of polyalphaolefins or alphaolefin oligomers, it is possible to use one kind alone of the aforementioned alphaolefins (monomers) or to use two kinds or more in combination. The aforementioned polyalphaolefins may be manufactured by a single polymerisation of one kind of alphaolefin or may be manufactured by co-polymerisation of two or more kinds of alphaolefins. In other words, the aforementioned polyalphaolefins may be single polymers (homopolymers) of one kind of alphaolefin (monomer) or may be co-polymers of two or more kinds of alphaolefins.

(1-1-3) Constituent (A3):

Constituent (A3) is a base oil the kinematic viscosity of which at 100° C. is in the range of from 1.4 to 12 $mm^2/s$, and is a hindered ester, diester or mixture (hindered ester and diester) thereof.

Hindered esters are esters of hindered alcohols and fatty acids.

Hindered alcohols are polyhydric alcohols which have neopentyl groups that contain quaternary carbon atoms in their molecules, preferably having from 5 to 30 carbon atoms. The hindered alcohols also even more preferably have from 5 to 20 carbon atoms, and especially from 10 to 20 carbon atoms.

As examples of hindered alcohols mention may be made of neopentyl glycol, 2,2-diethylpropane-1,3-diol, 2,2-dibutylpropane-1,3-diol, 2-methyl-2-propylpropane-1,3-diol, 2-ethyl-2-butylpropane-1,3-diol, trimethylolethane, trimethylolpropane, ditrimethylopropane, tritrimethylolpropane, tetratrimethylolpropane, pentaerythritol, dipentaerythritol, tripentaerythritol, tetrapentaerythritol and pentapentaerythritol. The hindered alcohols which form hindered esters may be one kind or two or more kinds of these. Hindered alcohols with a high viscosity are preferred, and dipentaerythritol, tripentaerythritol and the like are specifically preferred.

For the fatty acid a linear or branched fatty acid having from 4 to 20 carbon atoms is preferred. A fatty acid with from 4 to 12 carbon atoms is more preferred, and one with from 5 to 9 carbon atoms is especially preferred. As examples of linear fatty acids mention may be made of n-butanoic acid, n-pentanoic acid, n-hexanoic acid, n-heptanoic acid, n-octanoic acid, n-nonanoic acid, n-decanoic acid, n-undecanoic acid, n-dodecanoic acid, n-tridecanoic acid, n-tetradecanoic acid, n-pentadecanoic acid, n-hexadecanoic acid, n-heptadecanoic acid and n-octadecanoic acid. The linear fatty acids which form hindered esters may be one kind or two or more kinds of these. As examples of branched fatty acids mention may be made of 2-methylpropanoic acid, 2-methylbutanoic acid, 3-methylbutanoic acid, 2,2-dimethylpropanoic acid, 2-ethylbutanoic acid, 2,2-dimethylbutanoic acid, 2,3-dimethylbutanoic acid, 2-ethylpentanoic acid, 2,2-dimethylpentanoic acid, 2-ethyl-2-methylbutanoic acid, 3-methylhexanoic acid, 2-methylheptanoic acid, 2-ethylhexanoic acid, 2-propylpentanoic acid, 2,2-dimethylhexanoic acid, 2-ethyl-2-methylpentanoic acid, 2-methyloctanoic acid, 2,2-dimethylheptanoic acid, 2-ethylheptanoic acid, 2-methylnonanoic acid, 2,2-dimethyloctanoic acid, 2-ethyloctanoic acid, 2-methylnonanoic acid, 2,2-dimethylnonanoic acid and branched fatty acids with 11 or more carbons. The branched fatty acids which form hindered esters may be one kind or two or more kinds of these.

In the case of using two or more kinds of fatty acids which form hindered esters, fatty acids of fewer than 4 carbons (for example, n-propanoic acid) may be used so that the average number of carbons of the "fatty acid-derived hydrocarbon groups" which form the hindered esters (where the carbon number of the "fatty acid-derived hydrocarbon groups" (mole number) is divided by the hindered ester number (mole number)) becomes 4 to 8.

The hindered esters can be manufactured by the manufacturing methods of the prior art. For example, mention may be made of (a) the method whereby a hindered alcohol and a fatty acid are directly esterified by dehydration and condensation without a catalyst or in the presence of an acidic catalyst. Mention may also be made of (b) the method whereby a fatty acid chloride is prepared and the fatty acid chloride obtained and a hindered alcohol are reacted. Mention may further be made of (c) the method of manufacture by transesterification of esters of lower alcohols and fatty acids with hindered alcohols. Specifically, it is preferable to manufacture hindered esters by any of the aforementioned methods (a) to (c) by using hindered alcohols of having from 5 to 30 carbon atoms and fatty acids having from 4 to 20 carbon atoms.

As examples of diesters mention may be made of dicarboxylic acid diesters and dihydric alcohol diesters. Of these, dicarboxylic acid diesters are preferred. For the diesters it is possible to use one kind of diester alone or to use a combination (by mixing) of two or more kinds of diester.

For the dicarboxylic acid diesters, diesters of aliphatic dicarboxylic acids and monohydric alcohols are preferred. For dihydric alcohol diesters, diesters of aliphatic monocarboxylic acids and dihydric alcohols are preferred.

As examples of aliphatic dicarboxylic acids mention may be made of malonic acid, methylmalonic acid, dimethylmalonic acid, ethylmalonic acid, diethylmalonic acid, glutaric acid, dimethylglutaric acid, diethylglutaric acid, di-n-propylglutaric acid, diisopropylglutaric acid, dibutylglutaric acid, adipic acid, dimethyladipic acid, diethyladipic acid, dipropyladipic acid, dibutyladipic acid, succinic acid, methylsuccinic acid, dimethylsuccinic acid, ethylsuccinic acid, diethylsuccinic acid, dipropylsuccinic acid, dibutylsuccinic acid, pimeric acid, tetramethylsuccinic acid, suberic acid, azelaic acid, sebacic acid, dodecanoic diacid and brassylic acid.

As examples of monohydric alcohols, mention may be made of methanol, ethanol, propanol, isopropanol, butanol, pentanol, hexanol, heptanol, octanol, 2-ethylhexanol, nonanol, decanol, isodecanol, undecanol, dodecanol, tridecanol, tetradecanol and pentadecanol. The monohydric alcohols which form esters with the two carboxylic acids in dicarboxylic acid molecules may be the same kind or may be of different kinds.

As examples of aliphatic monocarboxylic acids mention may be made of acetic acid, n-propionic acid, n-butyric acid, isobutyric acid, n-valeric acid, n-hexanoic acid, α-methylhexanoic acid, α-ethylvaleric acid, isooctylic acid, pelargonic acid, n-decanoic acid, isodecanoic acid, isotridecanoic acid and isohexadecanoic acid.

As examples of dihydric alcohols mention may be made of ethylene glycol, propylene glycol, butylene glycol, 2-butyl-2-ethylpropanediol and 2,4-diethyl-pentanediol.

The diesters preferably have a carbon number for all molecules of 20 to 42, but a carbon number within the molecules of 22 to 30 is more preferable and a carbon number within the molecules of 22 to 28 is especially preferred. Furthermore, diesters which consist of a combination of carboxylic acids having from 3 to 18 carbon atoms and alcohols having from 5 to 20 carbon atoms are preferred. The esterification of the carboxylic acids and alcohols can be carried out by the known art.

(1-1-4) Constituent (A4):

Constituent (A4) is a lubricating oil base oil the kinematic viscosity of which at 100° C. is in the range of from 7 to 50 $mm^2/s$. Constituent (A4) is preferably a lubricating oil base oil corresponding to Group I, Group II, Group III or Group IV in the base oil categories of the API (American Petroleum Institute) standards. It may also be a mixture of two to four kinds of these (Groups I to IV). Since constituent (A4) is incorporated in the lubricating oil composition with the purpose of modifying the viscosity and promoting dissolving of additives, the % $C_A$ as stipulated by ASTM D 3238 will be at least not less than 2.0, but preferably not less than 3.0 and more preferably not less than 3.5.

As specific examples of constituent (A4) mention may be made of paraffinic mineral oils and bright stock.

(1-2) Constituent B:

Constituent (B) is a molybdenum dialkyldithiocarbamate as expressed by the undermentioned Formula (1).

Chemical Formula 1

(1)

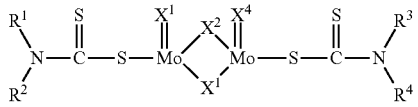

(In Formula (1), $R^1$ to $R^4$ denote alkyl groups, and $X^1$ to $X^4$ denote oxygen atoms or sulphur atoms.)

In the molybdenum dialkyldithiocarbamate, the elemental analysis value for the molybdenum is preferably in the range of from 9.5 to 10.5 mass %, and the elemental analysis value for the sulphur is preferably in the range of from 7.0 to 14.0 mass %.

Constituent (B) is incorporated in the lubricating oil composition of this form of embodiment in the amount, in terms of molybdenum, of from 250 to 2000 ppm, but preferably from 300 to 1800 ppm and more preferably from 350 to 1600 ppm. If it is less than 250 ppm, the amount of film formed by the molybdenum disulphide compounds becomes small, so that the friction reducing effect and the fuel economy effect are reduced, which is not desirable. If it is greater than 2000 ppm, corrosion of non-ferrous metals is caused, which is not desirable. This would also mean the expensive molybdenum is used worthlessly, which is not desirable from the standpoints of conservation of resources and reduction of costs. The content of constituent (B) in the lubricating oil composition can be determined by carrying out an elemental analysis using ICP (Inductively Coupled Plasma atomic emission spectroscopy) analysis apparatus (which may be referred to below as the ICP method). The amount of molybdenum can also be measured by the ICP method.

The alkyl groups $R^1$, $R^2$, $R^3$ and $R^4$ contained in the molybdenum dialkyldithiocarbamates as expressed by the aforementioned Formula (1) are each independently lipophilic groups of 2 to 30 carbons, and it is preferable if at least one of these four lipophilic groups is a secondary lipophilic group.

(1-3) Constituent (C):

Constituent (C) is tetrabenzyl thiuram disulphide as expressed by the undermentioned Formula (2).

Chemical Formula 2

(2)

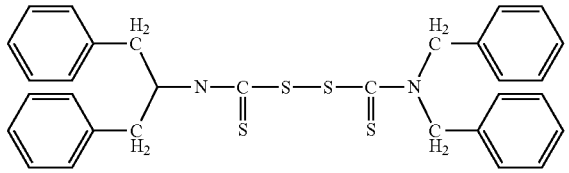

For the tetrabenzyl thiuram disulphide, the elemental analysis value of sulphur is preferably 23.5±1.0 mass %, and the elemental analysis value of nitrogen is preferably 5.1±0.5 mass %.

Constituent (C) is incorporated in the lubricating oil composition of this form of embodiment in the amount, in terms of sulphur, of from 20 to 500 ppm, but preferably from 50 to 350 ppm, more preferably from 80 to 350 ppm and especially from 150 to 350 ppm. If it is less than 20 ppm, the amount of sulphur supplied by constituent (B) becomes small, and the amount of film formed by the molybdenum disulphide compounds becomes small, so that the friction reducing effect and the fuel economy effect are reduced, which is not desirable. If it is greater than 500 ppm, the amount of sulphur supplied by constituent (B) will become too large, and the amount of sulphur in the exhaust gases emitted by the engine will increase, so that the catalyst to clean the engine's exhaust gases will be poisoned by said sulphur, which is not desirable. The content of constituent (C) in the lubricating oil composition can be measured by using the x-ray fluorescence technique (ASTM D4294 and JIS K2541-4).

Because the vapour pressure of constituent (C) is lower than that of tetraalkyl thiuram disulphides, even if the amount used is small it is unlikely to be volatilised inside the engine and so it will supply a sulphur component reliably to the sliding surfaces. By virtue of this, formation of a film of molybdenum disulphide compounds on the sliding surfaces can be promoted, and said film can be maintained. Also, because the amount of constituent (C) used can be made small, it is possible to inhibit poisoning by sulphur of the catalyst used for cleaning the exhaust gases. Were the vapour pressure to be high, it would volatilise inside the engine and eventually disappear, so that a film of molybdenum disulphide compounds would be unlikely to form on the sliding surfaces, which is not desirable.

(1-4) Constituent (D):

Constituent (D) is an amine as expressed by the undermentioned Formula (3) or Formula (4). Amines as expressed by the undermentioned Formula (3) are primary amines, and the amines as expressed by Formula (4) are secondary amines. In other words, constituent (D) contains no tertiary amines. This is because it is difficult to dissolve tetrabenzyl thiuram disulphide with tertiary amines. From the standpoint of solubility of tetrabenzyl thiuram disulphide in respect of the base oil, primary amines are preferred over secondary amines because it is then easier to dissolve the tetrabenzyl thiuram disulphide. Constituent (D) may also be a mixture of primary amines as expressed by Formula (3), a mixture of secondary amines as expressed by Formula (4) or a mixture of "primary amines as expressed by Formula (3) and secondary amines as expressed by Formula (4)".

Chemical Formula 3

(3)

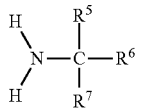

(In Formula (3), $R^5$ to $R^7$ denote, each independently, hydrogen or an "alkyl group, aryl group or alkylaryl group" having from 1 to 23 carbon atoms. It is preferable if at least one of $R^5$ to $R^7$ is an "alkyl group, aryl group or alkylaryl group" having from 7 to 23 carbon atoms.)

[Chemical Formula 4

(4)

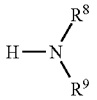

(In Formula (4), $R^8$ and $R^9$ denote, each independently, hydrogen or an "alkyl group, aryl group or alkylaryl group" having from 1 to 23 carbon atoms. It is preferable if at least one of $R^8$ and $R^9$ is an "alkyl group, aryl group or alkylaryl group" having from 7 to 23 carbon atoms.)

The lubricating oil composition of this form of embodiment contains from 0.05 to 3.0 mass % of constituent (D), but preferably contains from 0.05 to 2.0 mass %, and more preferably contains from 0.05 to 1.0 mass %. If there is less than 0.05 mass %, the effect of improving "solubility of tetrabenzyl thiuram disulphide (constituent (C)) in respect of the lubricating oil composition" may be reduced. If there is more than 3.0 mass %, in cases where a zinc dialkyldithiophosphate is used as an anti-wear agent, the anti-wear effect of said zinc dialkyldithiophosphate may be reduced.

It is preferable if the amines (constituent (D)) are liquid at room temperatures of 20 to 25° C.

By incorporating constituent (D) it is possible to improve the solubility of tetrabenzyl thiuram disulphide in respect of the lubricating oil composition. By virtue of this, it is possible to effect dispersion (dissolving) of the tetrabenzyl thiuram disulphide uniformly in the lubricating oil composition, which means it becomes possible to form a film with the molybdenum disulphide compounds effectively.

In order to improve wear-resisting properties, it is preferable to incorporate a zinc dialkyldithiophosphate, which is an anti-wear agent, in the lubricating oil composition of this form of embodiment. However, constituent (D), which is incorporated in the lubricating oil composition of this form of embodiment is, as mentioned above, a primary amine as expressed by Formula (3) or a secondary amine as expressed by Formula (4). If a zinc dialkyldithiophosphate and an amine are thus incorporated in the lubricating oil composition, the anti-wear agent effect due to the zinc dialkyldithiophosphate may be reduced by the amine. For this reason, and from the standpoint of not reducing the "anti-wear agent effect due to the zinc dialkyldithiophosphate", it is preferable if the steric hindrance of the substituent groups linked to nitrogen in constituent (D) is on the large side.

For this reason it is desirable if, in the case of primary amines as expressed by the aforementioned Formula (3), the substituent groups linked to nitrogen atoms are tertiary alkyl groups. It is also preferable if, in the case of primary amines as expressed by the aforementioned Formula (3), at least one of $R^5$ to $R^7$ of constituent (D) is an alkyl group, an aryl group or an alkylaryl group having from 7 to 23 carbon atoms. It is also preferable if two of $R^5$ to $R^7$ are alkyl groups, aryl groups or alkylaryl groups. Further, in order to enhance the solubility of the tetrabenzyl thiuram disulphide, and to enhance the friction reducing effect without reducing the wear-resisting properties of the zinc dialkyldithiophosphate, it is desirable if constituent (D) is a mixture of primary amines in which "the substituent groups linked to nitrogen atoms are tertiary alkyl groups" (tertiary alkyl-linked primary amines) and primary amines in which "at least one of $R^5$ to $R^7$ of constituent (D) is an aryl group or an alkylaryl group" (aryl-linked primary amines).

Also, in the case of secondary amines as expressed by the aforementioned Formula (4), it is desirable if at least one of $R^8$ and $R^9$ in constituent (D) is a tertiary alkyl group, aryl group or alkylaryl group. It is also desirable if both $R^8$ and $R^9$ are tertiary alkyl groups, aryl groups or alkylaryl groups. Further, in order to enhance the solubility of the tetrabenzyl thiuram disulphide, and to enhance the friction reducing effect without reducing the wear-resisting properties of the zinc dialkyldithiophosphate, it is also desirable if constituent (D) is a mixture of secondary amines in which "at least one of $R^8$ and $R^9$ in constituent (D) is a tertiary alkyl group and does not contain an aryl group or an alkylaryl group" (tertiary alkyl linked secondary amine) and a secondary amine in which "at least one of $R^8$ and $R^9$ is an aryl group or an alkylaryl group" (aryl linked secondary amine).

Also, in order to enhance the solubility of tetrabenzyl thiuram disulphide, and to enhance the friction reducing effect without reducing the wear-resisting characteristics of zinc dialkyldithiophosphates, it is desirable either if constituent (D) is a mixture of the aforementioned tertiary alkyl linked primary amines and the aforementioned aryl linked secondary amines or if it is a mixture of the aforementioned tertiary alkyl linked secondary amines and the aforementioned aryl linked primary amines.

As specific examples of constituent (D), mention may be made of amines of the "Primene® amines series" sold by Rohm and Haas Japan K.K. (for example, Primene 81-R® and Primene JM-T®) and Di-tridecylamine sold by Japan Chemtech Ltd. Primene 81-R® is a tertiary alkyl-primary amine mixture, and the carbon number of alkyl groups linked to nitrogen atoms is 12 to 14. Primene JM-T® is a tertiary alkyl-primary amine mixture, and the carbon number of alkyl groups linked to nitrogen atoms is 18 to 22.

(1-5) Other Additives

It is preferable to add to the lubricating oil composition of this form of embodiment, as required, at least one kind of other additive selected from the group consisting of metallic detergents, ashless dispersants, anti-wear agents (zinc dialkyldithiophosphates), rust preventatives, metal deactivators, anti-oxidants, viscosity index improvers, pour point depressants and defoamers. Further, it is also possible to incorporate in the lubricating oil composition of this form of embodiment at least one kind of other additive selected from the group consisting of demulsifiers and rubber swelling agents. The aforementioned other kinds of additive may be blended in alone or in mixtures of a plurality of kinds. Of these, it is preferable to incorporate at least zinc dialkyldithiophosphates, which are anti-wear agents, with a view to improving the wear-resisting properties of the lubricating oil composition.

(1-5-1) Metallic Detergents

For metallic detergents at least one kind of metallic detergent selected from the group consisting of alkaline earth metal sulphonates, alkaline earth metal phenates and alkaline earth metal salicylates is preferred. Metallic detergents are normally sold commercially, and so can be procured, in a form diluted in a light lubricating base oil, but it is preferable to use those with a metal content of from 1.0 to 20 mass %, and it is more preferable to use those with a metal content of from 2.0 to 16 mass %.

The base number of the metallic detergents (alkaline earth metal detergents) is not specially restricted, but a value of not more than 500 mgKOH/g is preferable, and a value in the range of from 150 to 450 mgKOH/g is more preferable. Base number here means the base number determined in accordance with "9." (Perchloric acid method) of "Petroleum products and lubricants—Determination of neutralisation value" in JIS K 2501. The content of metallic detergent in the lubricating oil composition is not specially restricted, but, relative to the total lubricating oil composition, is preferably in the range of from 0.1 to 10 mass %, and more preferably in the range of from 0.5 to 8 mass %, but is especially in the range of from 1 to 5 mass %. If it exceeds 10 mass %, this will give rise to early occurrence of clogging of the emissions aftertreatment apparatus, in particular the DPF (Diesel Particulate Filter), which is not desirable.

(1-5-2) Ashless Dispersants

For ashless dispersants it is possible to use any ashless dispersants generally used for lubricating oil compositions. As examples mention may be made of "mono-succinimides or bis-succinimides" having in their molecules at least one "linear or branched" "alkyl group or alkenyl group" having from 40 to 400 carbon atoms, benzylamines having in their molecules at least one "alkyl group or alkenyl group" having from 40 to 400 carbon atoms, polyamines having in their molecules at least one "alkyl group or alkenyl group" having from 40 to 400 carbon atoms, or products thereof modified by, for example, boron compounds, carboxylic acids or phosphoric acid. At time of use, it is possible to blend in one kind or two or more kinds selected from any of these. In particular, it is preferable to use as ashless dispersants bis-type polybutenyl succinimides, bis-type polybutenyl succinimide derivatives, or mixtures thereof.

The weight average molecular weight of "alkyl groups or alkenyl groups" present in the molecules of the ashless dispersant is preferably not less than 1000, but more preferably is not less than 2000, especially preferably is not less than 2500 and most preferably is not less than 3000. If the weight average molecular weight is less than 1000, the sludge dispersion characteristics will be inferior because the molecular weight of the polybutenyl group, which is a non-polar group, will be small. Also, the amine portion, which is a polar group which has a risk of becoming an activation point for oxidative ageing, becomes relatively large and so there is a possibility of deterioration of oxidative stability. From these standpoints, the amount of nitrogen contained in the ashless dispersant is preferably not more than 3 mass %, but more preferably is not more than 2 mass % and especially is not more than 1 mass %. Also, the amount of nitrogen contained in the ashless dispersant is preferably not less than 0.1 mass %, but more preferably not less than 0.5 mass %. From the standpoint of preventing deterioration of low temperature viscosity characteristics, however, the weight average molecular weight of "alkyl groups or alkenyl groups" present in the molecules is preferably not more than 6000 and more preferably not more than 5000. The weight average molecular weight of "alkyl groups or alkenyl groups" which the ashless dispersant has in its molecules preferably lies within the aforementioned range irrespective of whether it is mono-type or bis-type.

The content of ashless dispersant in the lubricating oil composition of this form of embodiment, relative to the total lubricating oil composition and in terms of elemental nitrogen, is preferably not less than 0.005 mass %, but more preferably not less than 0.01 mass % and especially not less than 0.05 mass %. The content of ashless dispersant, relative to the total lubricating oil composition and in terms of elemental nitrogen, is also preferably not more than 0.3 mass %, but more preferably not more than 0.2 mass % and especially not more than 0.15 mass %. If the amount of ashless dispersant is less than 0.005 mass %, it may be that sufficient detergent effect cannot be displayed. Also, if the amount of ashless dispersant exceeds 0.3 mass %, low temperature viscosity characteristics and demulsification characteristics may deteriorate. It is preferable if the lubricating oil composition of this form of embodiment contains a succinimide-based ashless dispersant with a weight average molecular weight of not more than 8500. Satisfactory sludge dispersion characteristics will thus be displayed and the low temperature viscosity characteristics will be superior.

Also, in the case where ashless dispersants modified by boron compounds are used, the amount of said ashless dispersant, relative to the total lubricating oil composition and in terms of elemental boron, is preferably not less than 0.005 mass %, but more preferably not less than 0.01 mass % and especially not less than 0.02 mass %. The amount of said ashless dispersant, relative to the total lubricating oil composition and in terms of elemental boron, is also preferably not more than 0.2 mass %, but more preferably not more than 0.1 mass %. If the amount of ashless dispersant modified by a boron compound is smaller than 0.005 mass %, it may be that sufficient detergent effect cannot be displayed. Also, if the amount of ashless dispersant modified by a boron compound exceeds 0.2 mass %, low temperature viscosity characteristics and demulsification characteristics may deteriorate.

(1-5-3) Anti-Wear Agents (Zinc Dialkyldithiophosphates):

As examples of zinc dialkyldithiophosphates which are anti-wear agents, mention may be made of zinc diisobutyldithiophosphate and zinc di 4-methyl 2-pentyldithiophosphate. As well as having a function as an anti-wear agent, the zinc dialkyldithiophosphate also has a function as an antioxidant. The amount of zinc dialkyldithiophosphate, relative to the total lubricating oil composition and in terms of zinc, is in the range of from 0.02 to 0.15 mass %, but preferably in the range of from 0.05 to 0.12 mass %, and further it is especially in the range of from 0.06 to 0.10 mass %.

(1-5-4) Rust Preventatives:

As examples of rust preventatives mention may be made of petroleum sulphonates, alkylbenzene sulphonates, dinonylnaphthalene sulphonates, metal salts of sulphonates, amine salts of sulphonates, zinc naphthenate, alkenylsuccinate esters and polyhydric alcohol esters.

(1-5-5) Metal Deactivators:

As examples of metal deactivators mention may be made of imidazoline, pyrimidine derivatives, alkylthiadiazoles, mercaptobenzothiazole, tolyltriazole, benzotriazole or derivatives thereof, 1,3,4-thiadiazole polysulphides, 1,3,4-thiadiazolyl-2,5-bisdialkyldithiocarbamates, 2-(alklyldithio) benzoimidazoles and β-(o-carboxybenzylthio)propionitrile.

(1-5-6) Anti-Oxidants:

As examples of anti-oxidants mention may be made of the amine-based anti-oxidants of the known art generally used for lubricating oils, such as the aromatic amine compounds alkyldiphenylamines, alkylnaphthylamines, phenyl-α-naphthylamines, alkylphenyl-α-naphthylamines, or phenol-based anti-oxidants of the known art, such as 4,4'-methylenebis(2,6-di-tert-butylphenol) and 4,4'-bis(2,6-di-tert-butylphenol), each respectively either alone or in plural combinations, or combinations of these amine-based anti-oxidants and phenol-based anti-oxidants.

(1-5-7) Viscosity Index Improvers:

As examples of viscosity index improvers mention may be made of non-dispersant type viscosity index improvers and dispersant type viscosity index improvers. As examples of non-dispersant viscosity index improvers, mention may be made of polymethacrylates and olefin polymers such as ethylene-propylene copolymers, styrene-diene copolymers, polyisobutylene and polystyrene. As examples of dispersant viscosity index improvers mention may be made of polymers which comprise copolymerisation of monomers that form the aforementioned non-dispersant type viscosity index improvers and nitrogen-containing monomers. Viscosity index improvers are desirable because they can effect an improvement in the viscosity characteristics of the lubricating oil composition. The viscosity index improver is preferably incorporated in the amount of from 0.05 to 20 mass % relative to the total lubricating oil composition.

(1-5-8) Pour Point Depressants:

Pour point depressants can be freely selected, according to the characteristics of the lubricating oil base oil, from any of the known pour point depressants, but a polymethacrylate is preferred. The weight average molecular weight of a polymethacrylate used as a pour point depressant is preferably in the range of from 10000 to 300000, but more preferably in the range of from 50000 to 200000. Pour point depressants are desirable because they can effect an improvement in the low temperature flow characteristics of the lubricating oil composition. The pour point depressant is preferably incorporated in an amount of from 0.05 to 20 mass % relative to the total lubricating oil composition.

(1-5-9) Defoamers:

For defoamers it is possible to use any compounds normally used as defoamers for lubricating oil compositions. As examples mention may be made of silicone-based defoamers such as polydimethyl siloxane and fluorine-based defoamers such as fluorosilicones, which are fluorine-modified silicones. One kind or two or more kinds freely selected from any of these of these compounds may be blended in optional amounts, and used as a defoamer.

(1-5-10) Demulsifiers:

As examples of demulsifiers, mention may be made of polyalkylene glycol-based non-ionic surface active agents such as polyoxyethylene alkyl ethers, polyoxyethylene alkylphenyl ethers and polyoxyethylene alkylnaphthyl ethers.

(1-5-11) Rubber Swelling Agents:

As examples of rubber swelling agents, mention may be made of various amine compounds and esters.

(1-5-12) Friction Modifiers:

As examples of friction modifiers (FM), mention may be made of organic molybdenum compounds such as "molybdenum dialkyldithiophosphates and amine complexes of molybdenum", fatty acid esters, fatty acid amines, fatty acid amides, neutral phosphate esters, amine salts of phosphate esters, thiophosphate esters and sulphurised oils and fats. Friction modifiers can be added in the small amount of 0.1 to 2 mass % relative to the total lubricating oil composition, being used chiefly to reduce friction.

(2) Method of Manufacture of the Lubricating Oil Composition:

Given next is an explanation of the method of manufacture of one form of embodiment of the lubricating oil composition of this invention.

The method of manufacture of one form of embodiment of the lubricating oil composition of this invention is a method in which a lubricating oil composition is obtained by mixing together (A) a lubricating oil base oil the kinematic viscosity of which at 100° C. is in the range of from 1.4 to 6 $mm^2/s$ (constituent (A)), (B) from 250 to 2000 ppm, in terms of molybdenum, of a molybdenum dialkyldithiocarbamate as expressed by the aforementioned Formula (1) (constituent (B)), (C) from 20 to 500 ppm, in terms of sulphur, of tetrabenzyl thiuram disulphide as expressed by the aforementioned Formula (2) (constituent (C)) and (D) from 0.05 to 3.0 mass % of an amine (constituent (D)).

(2-1)

As an example of the method of mixing the aforementioned constituent (A), constituent (B), constituent (C) and constituent (D), mention may be made of the method whereby, in a temperature range of 80 to 125° C., constituent (C) and constituent (D) are dissolved in a small amount of constituent (A) and, after cooling, constituent (B) is mixed with the mixture of constituent (A), constituent (C) and constituent (D). It is also possible to dissolve constituent (B) in constituent (A) (the lubricating oil base oil) in advance, but it is preferable to dissolve constituent (B) in the mixture of constituent (A), constituent (C) and constituent (D) after dissolving constituent (C) and constituent (D) in constituent (A) (the lubricating oil base oil) and cooling, because constituent (A) (the lubricating oil base oil) is heated in order to dissolve constituent (C).

(2-2)

As a method of mixing constituent (A), constituent (B), constituent (C) and constituent (D), the following method is also preferred. That is, the preferred method is one whereby a lubricating oil composition (the lubricating oil composition of this invention) containing "(A) a lubricating oil base oil the kinematic viscosity of which at 100° C. is in the range of from 1.4 to 6 $mm^2/s$, (B) from 250 to 2000 ppm, in terms of molybdenum, of a molybdenum dialkyldithiocarbamate as shown by the aforementioned Formula (1), (C) from 20 to 500 ppm, in terms of sulphur, of tetrabenzyl thiuram disulphide as shown by the aforementioned Formula (2) and (D) from 0.05 to 3.0 mass % of an amine" is prepared by preparing an amine solution (which may be referred to as solution (X) below) by dissolving tetrabenzyl thiuram disulphide as expressed by the aforementioned Formula (2) in a liquid mixture of an amine and a base oil (for example, constituent (A4)) in the temperature range of from 80 to 125° C. Then, said amine solution (solution (X), a lubricating oil base oil the kinematic viscosity of which at 100° C. is in the range of from 1.4 to 6 $mm^2/s$, and a molybdenum dialkyldithiocarbamate as expressed by the aforementioned Formula (1) are mixed in the temperature range of from 50 to 70° C. The base oil is preferably in an amount of the same order as the amine. By mixing constituent (A), constituent (B), constituent (C) and constituent (D) at the same time, and making the temperature of the whole in the range of from 80 to 125° C., constituent (A) or constituent (B) may give rise to decomposition due to heat, thermal degradation or oxidative ageing. But if dissolving is promoted by creating a high temperature of from 80 to 125° C. only when preparing a small amount of amine solution (solution (X)), and the temperature when mixing constituent (B) and a large amount of constituent (A) is kept in the range of from 50 to 70° C., it will be possible to avoid decomposition due to heat, thermal degradation and oxidative ageing.

(2-2-1) Solution (X):

As mentioned above, it is difficult to dissolve the tetrabenzyl thiuram disulphide in constituent (A) (the lubricating oil base oil). For this reason, in the prior art irrespective of application or purpose, tetrabenzyl thiuram disulphide has not been used much as an additive in lubricating oil compositions. On the other hand, by, for example, mixing the tetrabenzyl thiuram disulphide as well as an amine with constituent (A) (the lubricating oil base oil) in the temperature range of from 80 to 125° C., as mentioned above it becomes possible to make the tetrabenzyl thiuram disulphide dissolve readily in constituent (A) (the lubricating oil base oil). However, there may also be deterioration of the lubricating oil base oil or the additives, depending on type, by virtue of the heat, and, where practicable, it is preferable to avoid heating the lubricating oil base oil and additives more than is necessary.

In response to issues such as those mentioned above, the inventors have discovered that an amine solution (solution (X)) obtained by dissolving tetrabenzyl thiuram disulphide in a liquid mixture of an amine and a base oil (for example, constituent (A4)) readily dissolves in constituent (A) (the lubricating oil base oil). By virtue of this, the problem whereby "the tetrabenzyl thiuram disulphide is difficult to dissolve in constituent (A) (the lubricating oil base oil)" has been resolved, and it has become possible to prepare, easily and while preventing deterioration of the constituents, a lubricating oil composition in which tetrabenzyl thiuram disulphide has been dissolved.

Solution (X) is an "amine solution containing tetrabenzyl thiuram disulphide and an amine" obtained by dissolving tetrabenzyl thiuram disulphide in a liquid mixture of an amine and a base oil (for example, constituent (A4). The amine is the aforementioned constituent (D) which forms part of the lubricating oil composition of this form of embodiment. The tetrabenzyl thiuram disulphide is the aforementioned constituent (C) which also forms part of the lubricating oil composition of this form of embodiment. Constituent (A4) is a lubricating oil base oil the kinematic viscosity of which at 100° C. is in the range of from 7 to 50 $mm^2/s$. Constituent (A4) is preferably also a lubricating oil base oil which corresponds to Group I, Group II, Group II or Group IV of the categories stipulated by the API (American Petroleum Institute). It is also possible to use mixtures of two to four kinds of these (Groups I to IV). Constituent (A4) is incorporated in the lubricating oil composition with the purpose of regulating the viscosity and aiding solubility of additives. The "% $C_A$" of constituent (A4) as stipulated by ASTM D3238 is preferably not less than 2.0, and more preferably not less than 3.0 but not more than 5.0.

The proportion of tetrabenzyl thiuram disulphide contained in solution (X) is preferably in the range of from 20 to 50 mass %, but more preferably in the range of from 30 to 50 mass % and especially in the range of from 30 to 40 mass %. If it is less than 20 mass %, it will be necessary to add more of solution (X) in order to achieve the desired value for the concentration of the tetrabenzyl thiuram disulphide in the lubricating oil composition, so that the amount of amine added becomes too large, which is not desirable. If it is more than 50 mass %, it becomes difficult for the tetrabenzyl thiuram disulphide to dissolve, which is also not desirable.

It is preferable if the tetrabenzyl thiuram disulphide is dissolved uniformly in solution (X). In this case, it can be assessed as "uniform" if there is no precipitation visible to the naked eye.

(2-2-2) Method of Manufacture of Solution (X):

As mentioned above, the method of manufacture of the amine solution (solution (X)) is a method whereby an amine solution is prepared by dissolving tetrabenzyl thiuram disulphide (melting point: 124° C.) as expressed by the aforementioned Formula (2) in a liquid mixture of an amine and a base oil in a temperature range of from 80 to 125° C.

After dissolving the tetrabenzyl thiuram disulphide in the liquid mixture of amine and base oil, solution (X) is preferably cooled to 20 to 50° C., but more preferably cooled to a room temperature of from 20 to 25° C. Even if solution (X) is cooled to such temperatures, the tetrabenzyl thiuram disulphide will not separate out.

The method of dissolving the tetrabenzyl thiuram disulphide in the liquid mixture of amine and base oil is not specially limited, but a preferred method is to add the tetrabenzyl thiuram disulphide to the liquid mixture of amine and base oil and to agitate them. For the method of agitation, a preferred method is to place the tetrabenzyl thiuram disulphide and the liquid mixture of amine and base oil in a vessel (a dissolving tank or the like) and to use paddles or a stirrer for the agitation. It is also possible to agitate by installing a pump outside the vessel containing the tetrabenzyl thiuram disulphide and the liquid mixture of amine and base oil and circulating the liquid inside the vessel by means of the pump.

(2-2-3) Manufacture of Lubricating Oil Composition:

After preparing solution (X), the lubricating oil composition of this invention is prepared by mixing together said solution (X), a "lubricating oil base oil the kinematic viscosity of which at 100° C. is in the range of from 1.4 to 6 $mm^2/s$" and a "molybdenum dialkyldithiocarbamate as expressed by the aforementioned Formula (1)" in the temperature range of from 50 to 70° C.

For the "lubricating oil base oil the kinematic viscosity of which at 100° C. is in the range of from 1.4 to 6 $mm^2/s$" the aforementioned constituent (A) which forms part of the lubricating oil composition of this form of embodiment is preferred. For the "molybdenum dialkyldithiocarbamate as expressed by the aforementioned Formula (1)" the aforementioned constituent (B) which forms part of the lubricating oil composition of this form of embodiment is preferred.

The temperature at which solution (X), the "lubricating oil base oil the kinematic viscosity of which at 100° C. is in the range of from 1.4 to 6 $mm^2/s$" and the "molybdenum dialkyldithiocarbamate as expressed by the aforementioned Formula (1)" are mixed is in the range of from 50 to 70° C. If it is lower than 50° C., it becomes difficult to dissolve solution (X) and the "molybdenum dialkyldithiocarbamate as expressed by the aforementioned Formula (1)" uniformly in the "lubricating oil base oil the kinematic viscosity of which at 100° C. is in the range of from 1.4 to 6 $mm^2/s$". If it is higher than 70° C., there is a risk that thermal degradation may occur, which is not desirable.

The method of mixing solution (X), the "lubricating oil base oil with a kinematic viscosity at 100° C. in the range of from 1.4 to 6 $mm^2/s$" and the "molybdenum dialkyldithiocarbamate as expressed by the aforementioned Formula (1)" is not specially limited, but a preferred method is to add solution (X) and the molybdenum dialkyldithiocarbamate to the lubricating oil base oil the kinematic viscosity of which at 100° C. is in the range of from 1.4 to 6 $mm^2/s$ and to agitate them. For the method of agitation, a preferred method is to place solution (X), the "lubricating oil base oil the kinematic viscosity of which at 100° C. is in the range of from 1.4 to 6 $mm^2/s$" and the "molybdenum dialkyldithiocarbamate as expressed by the aforementioned Formula (1)" in a vessel (a dissolving tank or the like) and to use paddles or a stirrer for the agitation. It is also possible to agitate by installing a pump outside the vessel and circulating the liquid inside the vessel by means of the pump.

It is preferable to add solution (X) to the "lubricating oil base oil the kinematic viscosity of which at 100° C. is in the range of from 1.4 to 6 $mm^2/s$" so that the "blended amount of tetrabenzyl thiuram disulphide relative to the total lubricating oil composition becomes 20 to 500 ppm, in terms of sulphur". Further, the amount of solution (X) added will more preferably be in the range of from 50 to 350 ppm based on the aforementioned sulphur conversion, preferably in the range of from 80 to 350 ppm based on the aforementioned sulphur conversion, and most preferably in the range of from 150 to 350 ppm.

It is preferable to add the "molybdenum dialkyldithiocarbamate as expressed by the aforementioned Formula (1)" to the "lubricating oil base oil the kinematic viscosity of which at 100° C. is in the range of from 1.4 to 6 $mm^2/s$" so that it is present in an amount of from 250 to 2000 ppm, in terms of molybdenum, relative to the total lubricating oil composition. Further, the amount of molybdenum dialkyldithiocarbamate added is more preferably in the range of from 300 to 1800 ppm in terms of molybdenum and especially in the range of from 350 to 1600 ppm in terms of molybdenum.

When solution (X) is mixed with the "lubricating oil base oil the kinematic viscosity of which at 100° C. is in the range of from 1.4 to 6 $mm^2/s$" and the "molybdenum dialkyldithiocarbamate as expressed by the aforementioned Formula (1)", it is also possible to add "other additives". As examples of the "other additives" mention may be made of the "other additives" which can be blended in the aforementioned form of embodiment of the lubricating oil composition of this invention. The amounts added of each of the "other additives" are preferably determined so that the preferred blend amount of each of the "other additives" is as blended in the aforementioned form of embodiment of the lubricating oil composition of this invention.

EXAMPLES

Given below in more specific detail is an explanation of examples of the present invention, but the invention is in no way limited by any of these examples.

Solution X 50 g of tetrabenzyl thiuram disulphide as expressed in the aforementioned Formula (2), 25 g of amine-1 (an amine as expressed by the aforementioned Formula (3)), 25 g of amine-4 (an amine as expressed by the aforementioned Formula (4)) and 50 g of "base oil 2", a paraffinic mineral oil being constituent (A4), were mixed together in a conical beaker, and a uniform yellow solution (solution (X-1)) was obtained by raising the temperature to 130° C. and agitating by means of a stirrer for 15 minutes. By this means, it was possible to dissolve the aforementioned tetrabenzyl thiuram disulphide in the aforementioned amine and "base oil 2", the paraffinic mineral oil which was constituent (A4), and to obtain solution (X-1). After this, solution (X-1) was cooled to room temperature (25° C.). Even though solution (X-1) had cooled to room temperature, no crystals (crystals of tetrabenzyl thiuram disulphide) separated out. Solution (X-1) is one example of Solution (X). Amine-1 was procured from Rohm and Haas Japan Ltd, and its trade name is Primene JM-T. The trade name of amine-4 is Naugalube 640 (an alkyldiphenylamine) made by Chemtura Inc. of the USA. Table 3 shows the composition ratios for solution (X-1). Table 3 also shows the composition ratios for Solution (X-2) and Solution (X-3). "Sanceler TBZTD" made by Sanshin Chemical Industry Co. Ltd. was used for the tetrabenzyl thiuram disulphide.

Lubricating Oil Composition

Next, to the conical beaker were added 8.9 g of the gasoline engine oil package additives for GF5 (GF5 package), 0.3 g of solution (X-1), 0.7 g of a "molybdenum dialkyldithiocarbamate as expressed by the aforementioned Formula (1)" (organic molybdenum), 9.3 g of a viscosity index improver, 0.4 g of a pour point depressant and 0.03 g of a defoamer solution, and finally 80.37 g of "Base oil 1" were added.

The commercial package Oronite made by Chevron Japan Ltd. was used for the gasoline engine oil package additives for GF5 (GF5 package). It contained a blend of a metallic detergent, a succinimide and a boron-modified succinimide, a zinc dialkyldithiophosphate, an anti-oxidant, a metal deactivator and a rust preventative. Solution (X-1) was added so that the content of tetrabenzyl thiuram disulphide in the lubricating oil composition became 235 ppm in terms of sulphur. The molybdenum dialkyldithiocarbamate was added so that the content of molybdenum dialkyldithiocarbamate in the lubricating oil composition became 700 ppm in terms of molybdenum. A commercial product of trade name "Adeka Sakura-Lube 525" made by Adeka Co. Ltd. was used for the molybdenum dialkyldithiocarbamate. A non-dispersant type of ethylene-propylene copolymer viscosity index improver was used for the viscosity index improver. A 3% concentration of polydimethylsiloxane in kerosene (polydimethylsiloxane:kerosene=3:97 (mass ratio)) was used for the defoamer solution (commercial name SHF12500, made by Dow Corning Co. Ltd.). The units "ppm" are based on mass.

Next, the temperature of the mixture in the conical beaker was raised to 70° C., and the lubricating oil composition was obtained after agitating with a stirrer for 20 minutes. The kinematic viscosity at 100° C. of the lubricating oil composition was 8.3 $mm^2/s$. The kinematic viscosity was determined by the method of JIS K2283.

Base Oil Characteristics

Base oil 1 was a Group III base oil (kinematic viscosity at 100° C.: 4.21 $mm^2/s$, VI (viscosity index): 123.) Base oil 2 was a paraffinic Group I base oil (kinematic viscosity at 100° C.: 7.6 $mm^2/s$, VI (viscosity index): 99). Base oil 1 was constituent (A1) in lubricating oil base oil (A) and base oil 2 was constituent (A4) in lubricating oil base oil (A). Base oil 3 as used in Example 8 and shown below was a Group I base oil (kinematic viscosity at 100° C.: 4.56 $mm^2/s$, VI (viscosity index): 99). Table 4 shows the characteristics of base oils 1 to 3. Table 4 shows the values for "% $C_A$", "% $C_N$" and "% $C_P$", determined by the methods of ASTM D3238-95.

A "friction test" was carried out, by the method shown below, on the lubricating oil compositions obtained. The results are shown in Table 1.

In Tables 1 and 2, the rubric "Organic molybdenum" denotes the mass (g) of the total molybdenum dialkyldithiocarbamate relative to the total lubricating oil composition, and the "amount added (ppm) in terms of molybdenum" of the molybdenum dialkyldithiocarbamate relative to the total lubricating oil composition. The rubrics Solution (X-1), Solution (X-2), Solution (X-3) and Solution (X-4) respectively denote the content (mass %) of solution (X-1), solution (X-2), solution (X-3) and solution (X-4) respectively relative to the total lubricating oil composition. The rubric "Amine content of solution (X)" denotes the content (mass %) of amines in "solution (X-1), solution (X-2), solution (X-3) or solution (X-4)" relative to the total lubricating oil composition. The rubric "Thiuram content in Solution X" denotes the total amount of tetrabenzyl thiuram disulphide added (mass %) relative to the total lubricating oil composition and the "amount added (ppm) in terms of sulphur" of tetrabenzyl thiuram disulphide relative to the total lubricating oil composition. "GF-5 package" means the gasoline engine oil package additives for GF5. "GF-4 package" means the gasoline engine oil package additives for GF4. The rubric "Kinematic viscosity" denotes the kinematic viscosities at 100° C. ($mm^2/s$) of the lubricating oil compositions obtained.

Friction Test

The friction coefficients for the lubricating oil compositions obtained were determined by the method stipulated in ASTM-D-2714-94 (LFW-1 friction test), and the width of the wear scar after the test was confirmed.

The conditions for measuring the friction coefficient were a test load of 1069 (N), a test duration of 30 (minutes) and test speed of 546 (rpm) (1 (m/s)). The temperature of the test oil was set at 75±3° C. for the initial 15 minutes, and then the temperature was raised at a rate of 5° C./minute up to 120° C., after which it was fixed at 120±3° C. until completion of the test. Measurements of the friction coefficient were carried out respectively at an oil temperature of 75° C. 15 minutes after start of the test, at an oil temperature of 100° C. about 20 minutes after start of the test and at an oil temperature of 120° C. 30 minutes after start of the test (immediately before completion of the test). In the case of width of the wear scar, the lower the value the better the wear-resisting properties, and it is preferably not more than 0.90 mm.

TABLE 1

| | | Ex. 1 | Ex. 2 | Ex. 3 | Ex. 4 | Ex. 5 | Ex. 6 | Ex. 7 | Ex. 8 | Ex. 9 |
|---|---|---|---|---|---|---|---|---|---|---|
| Base oil - 1 | Mass % | 80.37 | 80.92 | 80.62 | 80.37 | 80.22 | 79.92 | 80.37 | 80.37 | 70.07 |
| Base oil - 3 | Mass % | | | | | | | | | 7.00 |
| GF-4 package | Mass % | | | | | | | | | 9.00 |
| GF-5 package | Mass % | 8.90 | 8.90 | 8.90 | 8.90 | 8.90 | 8.90 | 8.90 | 8.90 | |
| Molybdenum | Mass % | 0.70 | 0.30 | 0.30 | 0.70 | 1.00 | 1.00 | 0.70 | 0.70 | 0.70 |
| dialkyldithiocarbamate | As Mo (ppm) | 700 | 300 | 300 | 700 | 1000 | 1000 | 700 | 700 | 700 |
| Solution X-1 | Mass % | 0.30 | | | | | | | | |
| Solution X-2 | Mass % | | 0.15 | 0.45 | 0.30 | 0.15 | 0.45 | | | 0.30 |
| Solution X-3 | Mass % | | | | | | | 0.30 | | |
| Solution X-4 | Mass % | | | | | | | | 0.30 | |
| Amine content of solution X | Mass % | 0.10 | 0.05 | 0.15 | 0.10 | 0.05 | 0.15 | 0.10 | 0.10 | 0.10 |
| Amount of thiuram-derived S | As sulphur (ppm) | 235 | 118 | 352 | 235 | 118 | 352 | 235 | 235 | 235 |
| Viscosity index improver | Mass % | 9.30 | 9.30 | 9.30 | 9.30 | 9.30 | 9.30 | 9.30 | 9.30 | 12.60 |
| Pour point depressant | Mass % | 0.40 | 0.40 | 0.40 | 0.40 | 0.40 | 0.40 | 0.40 | 0.40 | 0.30 |
| Defoamer solution | Mass % | 0.03 | 0.03 | 0.03 | 0.03 | 0.03 | 0.03 | 0.03 | 0.03 | 0.03 |
| Total | | 100.0 | 100.0 | 100.0 | 100.0 | 100.0 | 100.0 | 100.0 | 100.0 | 100.0 |
| Kinematic viscosity @100° C. | $mm^2/s$ | 8.3 | 8.3 | 8.3 | 8.3 | 8.3 | 8.3 | 8.3 | 8.3 | 9.9 |
| Friction coefficient | Oil temperature 75° C. | 0.121 | 0.124 | 0.124 | 0.117 | 0.117 | 0.121 | 0.119 | 0.118 | 0.087 |
| | Oil temperature 100° C. | 0.050 | 0.058 | 0.065 | 0.066 | 0.066 | 0.056 | 0.048 | 0.065 | 0.079 |
| | Oil temperature 120° C. | 0.046 | 0.048 | 0.048 | 0.048 | 0.048 | 0.048 | 0.045 | 0.048 | 0.068 |
| Wear scar width after test | mm | 0.86 | 0.88 | 0.88 | 0.86 | 0.88 | 0.87 | 0.70 | 0.94 | 0.85 |

TABLE 2

| | | Comp. Ex. 1 | Comp. Ex. 2 | Comp. Ex. 3 | Comp. Ex. 4 | Comp. Ex. 5 | Comp. Ex. 6 | Comp Ex. 7 | Comp. Ex. 8 | Comp. Ex. 9 |
|---|---|---|---|---|---|---|---|---|---|---|
| Base oil - 1 | Mass % | 81.10 | 81.25 | 81.10 | 80.95 | 81.10 | 81.10 | 80.70 | 80.40 | 70.80 |
| Base oil - 3 | Mass % | | | | | | | | | 7.00 |
| GF-4 package | Mass % | | | | | | | | | 9.00 |
| GF-5 package | Mass % | 8.90 | 8.90 | 8.90 | 8.90 | 8.90 | 8.90 | 8.90 | 8.90 | |
| Molybdenum | Mass % | | | | | | 0.30 | 0.70 | 1.00 | |
| dialkyldithiocarbamate | As Mo (ppm) | | | | | | 300 | 700 | 1000 | |
| Solution X-1 | Mass % | 0.30 | | | | | | | | |
| Solution X-2 | Mass % | | 0.15 | 0.30 | 0.45 | | | | | 0.30 |
| Solution X-3 | Mass % | | | | | 0.30 | | | | |
| Solution X-4 | Mass % | | | | | | | | | |
| Amine content of solution X | Mass % | 0.10 | 0.05 | 0.10 | 0.15 | 0.10 | | | | 0.10 |
| Amount of thiuram-derived S | As sulphur (ppm) | 235 | 118 | 235 | 352 | 235 | | | | 235 |

TABLE 2-continued

| | | | | | | | | | | |
|---|---|---|---|---|---|---|---|---|---|---|
| Viscosity index improver | Mass % | 9.30 | 9.30 | 9.30 | 9.30 | 9.30 | 9.30 | 9.30 | 9.30 | 12.60 |
| Pour point depressant | Mass % | 0.40 | 0.40 | 0.40 | 0.40 | 0.40 | 0.40 | 0.40 | 0.40 | 0.30 |
| Defoamer solution | Mass % | 0.00 | 0.00 | 0.00 | 0.00 | 0.00 | 0.00 | 0.00 | 0.00 | 0.00 |
| Total | | 100.0 | 100.0 | 100.0 | 100.0 | 100.0 | 100.0 | 100.0 | 100.0 | 100.0 |
| Kinematic viscosity @100° C. | $mm^2/s$ | | | | | | | | | |
| Friction coefficient | Oil temperature 75° C. | 0.129 | 0.126 | 0.134 | 0.130 | 0.133 | 0.132 | 0.118 | 0.117 | 0.129 |
| | Oil temperature 100° C. | 0.130 | 0.129 | 0.133 | 0.133 | 0.133 | 0.124 | 0.070 | 0.059 | 0.125 |
| | Oil temperature 120° C. | 0.130 | 0.129 | 0.133 | 0.133 | 0.132 | 0.068 | 0.063 | 0.057 | 0.118 |
| Wear scar width after test | mm | 0.81 | 0.83 | 0.87 | 0.89 | 0.87 | 0.95 | 0.94 | 0.95 | 0.89 |

| | | Comp. Ex. 10 | Comp. Ex. 11 | Comp. Ex. 12 |
|---|---|---|---|---|
| Base oil - 1 | Mass % | 70.40 | 71.10 | 81.40 |
| Base oil - 3 | Mass % | 7.00 | 7.00 | |
| GF-4 package | Mass % | 9.00 | 9.00 | |
| GF-5 package | Mass % | | | 8.90 |
| Molybdenum dialkyldithiocarbamate | Mass % | 0.70 | | |
| | As Mo (ppm) | 700 | | |
| Solution X-1 | Mass % | | | |
| Solution X-2 | Mass % | | | |
| Solution X-3 | Mass % | | | |
| Solution X-4 | Mass % | | | |
| Amine content of solution X | Mass % | | | |
| Amount of thiuram-derived S | As sulphur (ppm) | | | |
| Viscosity index improver | Mass % | 12.60 | 12.60 | 9.30 |
| Pour point depressant | Mass % | 0.30 | 0.30 | 0.40 |
| Defoamer solution | Mass % | 0.00 | 0.00 | 0.00 |
| Total | | 100.0 | 100.0 | 100.0 |
| Kinematic viscosity @100° C. | $mm^2/s$ | | 9.830 | 8.266 |
| Friction coefficient | Oil temperature 75° C. | 0.103 | 0.128 | 0.123 |
| | Oil temperature 100° C. | 0.069 | 0.125 | 0.125 |
| | Oil temperature 120° C. | 0.072 | 0.121 | 0.128 |
| Wear scar width after test | mm | 0.9 | 0.93 | 0.90 |

TABLE 3

| | | Solution (X-1) | Solution (X-2) | Solution (X-3) | Solution (X-4) | Solution (X-5) | Solution (X-6) |
|---|---|---|---|---|---|---|---|
| Base oil - 2 | Mass % | 33.3 | 33.3 | 33.3 | 33.3 | 33.3 | 33.3 |
| Tetrabenzyl thiuram disulphide | Mass % | 33.3 | 33.3 | 33.3 | 33.3 | 33.3 | 33.3 |
| Amine - 1 | Mass % | 16.7 | | | | | |
| Amine - 2 | Mass % | | 16.7 | | 33.4 | | |
| Amine - 3 | Mass % | | | 23.4 | | | |
| Amine - 4 | Mass % | 16.7 | 16.7 | 10.0 | | | |
| Amine - 5 | Mass % | | | | | 33.4 | |
| Amine - 6 | Mass % | | | | | | 33.4 |
| Remarks | | Liquid at normal temperatures | Liquid at normal temperatures | Liquid at normal temperatures | Liquid at normal temperatures | Crystals separate out below 120° C. | Crystals separate out below 120° C. |

TABLE 4

| | | | Base oil - 1 | Base oil - 2 | Base oil - 3 |
|---|---|---|---|---|---|
| Base oil group (API category) | | | Group III | Group I | Group I |
| Kinematic viscosity | 100° C. | $mm^2/s$ | 4.21 | 7.6 | 4.56 |
| | 40° C. | $mm^2/s$ | | 55.1 | 24.4 |
| Viscosity index | | | 123 | 99 | 99 |
| Pour point | | ° C. | −15 | −12.5 | −20 |
| Flash point | | ° C. | 214 | 256 | 228 |
| Sulphur component | | Mass % | 0.0008 | 0.6 | 0.5 |
| ASTM D3238-95 | | % $C_A$ | 0 | 3.2 | 3.4 |
| | | % $C_N$ | 22.4 | 30.7 | 30.1 |
| | | % $C_P$ | 77.6 | 66.1 | 66.5 |

Examples 2 to 9, Comparative Examples 1 to 12

Apart from the changes to the various conditions shown in Tables 1 to 3, lubricating oil compositions were prepared in the same way as in Example 1. "Friction tests" using the aforementioned method were performed on the lubricating oil compositions obtained. The results are shown in Tables 1 and 2.

"Amine-1" to "Amine-6" in Table 3 were as follows. "Amine-1" was "Primene JM-T"® procured from the company "Rohm and Haas Japan." "Amine 2" was "Primene 81R"® procured from the company "Rohm and Haas Japan." "Amine 3" was "Di-tridecylamine" sold by "Japan Chemtech Ltd.". "Amine-4" was "Naugalube 640"® made by "Chemtura Corp. USA". "Naugalube 640" is an alkyldiphenylamine. "Amine-5" was "Farmin DM1098"® made by Kao Ltd. Farmin DM1098 is a dimethyldecylamine. "Amine-6" was "Farmin D6098"® made by Kao Ltd. "Farmin D6098" is a dimethylpalmitylamine. "Amine-1" to "Amine-4" contained constituent (D). In Table 3, the tetrabenzyl thiuram disulphide was "Sanceler TBZTD" made by Sanshin Chemical Industry Co. Ltd.

It can be seen from Tables 1 and 2 that if the amount of molybdenum dialkyldithiocarbamate added is the same, lubricating oil compositions where a tetrabenzyl thiuram disulphide has further been added have a lower friction coefficient (Examples 1 to 9, Comparative Examples 1 to 12). From the results of Example 2 and Example 3, and Example 5 and Example 6, it can also be seen that the friction coefficient can be lowered by increasing the amount of tetrabenzyl thiuram disulphide added in the presence of a molybdenum dialkyldithiocarbamate. From the results of Examples 2 and 5, and Example 3 and Example 6, it can be seen that the friction coefficient stabilises at the various temperatures and exhibits low values through an increase in the amount of molybdenum dialkyldithiocarbamate added in the presence of tetrabenzyl thiuram disulphide. The lubricating oil composition of Example 2 (Example 3) combines use of tetrabenzyl thiuram disulphide and a molybdenum dialkyldithiocarbamate and so, notwithstanding the fact that the amount of molybdenum dialkyldithiocarbamate added is smaller than in the lubricating oil composition of Comparative Example 7 (Comparative Example 8), the friction coefficient at 120° C. of the lubricating oil composition of Example 2 (Example 3) has a lower value than the lubricating oil composition of Comparative Example 7 (Comparative Example 8). Also, as regards width of wear scar, it can be seen that it is less than 0.90 mm in the case of Examples 1 to 7 and 9, but in the case of Comparative Examples 6 to 8, where molybdenum dialkyldithiocarbamate has been added, the wear scar is more than 0.90 mm. From Comparative Examples 1 to 5 and 9 it can be seen that there was no friction reducing effect with just an amine and tetrabenzyl thiuram disulphide.

From Table 1 it can be seen that in the case of the lubricating oil compositions of Examples 1 to 7 and 9 the friction reducing effect is superior, the wear scar width being low and the friction coefficient being low, and so the fuel economy effect is superior. Further, solution (X-4) was used in the preparation of the lubricating oil composition of Example 8. Solution (X-4) contained "amine-2" and did not contain "amine-4". Whereas, in the case of "amine-2", alkyl groups which do not have very much steric hindrance are linked to the nitrogen atoms, in the case of "amine-4", which is an alkyldiphenylamine, substituent groups with large steric hindrance are linked to the nitrogen atoms. Normally, amines impair the effect of the wear-resisting properties of zinc dialkyldithiophosphates, but amines that contain substituent groups with large steric hindrance are not apt to impair the effect of the wear-resisting properties of zinc dialkyldithiophosphates. For this reason, if "amine-4" is incorporated in the lubricating oil composition, it means the effect of the wear-resisting properties of zinc dialkyldithiophosphates is not likely to be impaired, but if a lubricating oil composition contains "amine-2" and, as well, does not contain "amine-4", this means the effect of the wear-resisting properties of zinc dialkyldithiophosphates will be impaired. For the above reasons, the value of "wear scar width after the test" of the lubricating oil composition of Example 8 increased. The size of the "wear scar width after the test" is preferably not more than 0.90 mm, though if it is of the order of 0.94 mm, for practical purposes it is considered to be a usable value.

It was confirmed that the tetrabenzyl thiuram disulphide incorporated in the lubricating oil composition of this invention is less prone to volatilising than tetraalkyl thiuram disulphides, and that the proportion of sulphur remaining is higher.

Volatility Tests

The evaporation losses of the sulphur-based additives (tetrabenzyl thiuram disulphide and so on) were determined by the test method for determination of evaporation loss in engine oils as stipulated in ASTM D5800 (Noack evaporation loss test). More specifically, the sulphur-based additive was dissolved in a Group III base oil the kinematic viscosity of which at 100° C. was 4 $mm^2/s$, and a Noack evaporation loss test was performed. The masses of sulphur before and after the test were measured, and the rate of remaining sulphur was calculated as (100×(mass of sulphur after the test)/(mass of sulphur before the test)).

The volatility tests were carried out on tetrabenzyl thiuram disulphide (Commercial name: "Sanceler TBZTD" made by Sanshin Chemical Industry Co. Ltd.), and on tetraalkyl thiuram disulphides (tetraethyl thiuram disulphide (commercial name: Nocceler-TET, made by Ouchi Shinko Chemical Industrial Co. Ltd.), tetrabutyl thiuram disulphide (commercial name: Nocceler-TBT, made by Ouchi Shinko Chemical Industrial Co. Ltd.) and tetraoctyl thiuram disulphide (commercial name: Nocceler-TOT-N, made by Ouchi Shinko Chemical Industrial Co. Ltd.)).

The results of the volatility tests were that the rate of remaining sulphur in the tetrabenzyl thiuram disulphide was 12.18%, the rate of remaining sulphur in the tetraethyl thiuram disulphide was 8.04%, the rate of remaining sulphur in the tetrabutyl thiuram disulphide was 7.67%, and the rate of remaining sulphur in the tetraoctyl thiuram disulphide was 10.45%.

From the above it can be seen that the rate of remaining sulphur in the tetrabenzyl thiuram disulphide was higher than for the tetraalkyl thiuram disulphides. In can be seen by virtue of this that by using tetrabenzyl thiuram disulphide, not only is a high friction reducing effect manifested but emissions of a sulphur component that will cause deterioration of the catalyst function also become smaller.

Constituent (D) was not incorporated in solution (X-5) and solution (X-6) but a tertiary amine was incorporated. For this reason, in the cases of solution (X-5) and solution (X-6) crystals separated out above 120° C., and above 125° C. the crystals did not dissolve. For this reason, solution (X-5) and solution (X-6) could not be used to promote dissolving of tetrabenzyl thiuram disulphide in base oils.

The lubricating oil composition of this invention can ideally be used as a lubricating oil composition to be used in internal combustion engines such as automobile engines.

That which is claimed is:

1. A lubricating oil composition comprising:

(a) a lubricating oil base oil the kinematic viscosity of which at 100° C. is in the range of from 1.4 to 6 $mm^2/s$, (b) from 250 to 2000 ppm in terms of molybdenum of a molybdenum dialkyldithiocarbamate as expressed by the undermentioned Formula (1), (1)

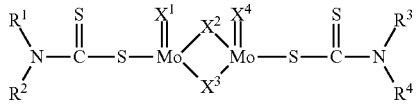

wherein in Formula (1), $R^1$ to $R^4$ denote alkyl groups, and $X^1$ to $X^4$ denote oxygen atoms or sulphur atoms, (c) 20 to 500 ppm in terms of sulphur of tetrabenzyl thiuram disulphide as expressed by the undermentioned Formula (2)

(2)

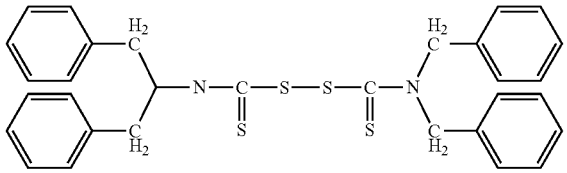

and (d) 0.05 to 3.0 mass % of an amine as expressed by the undermentioned Formula (3) Formula (4), or a mixture thereof, (3)

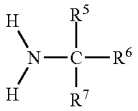

wherein in Formula (3), $R^5$ to $R^7$ denote, each independently, hydrogen or an "alkyl group, aryl group or alkylaryl group" having from 1 to 23 carbon atoms, and (4)

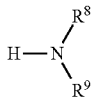

wherein in Formula (4), $R^8$ and $R^9$ denote, each independently, hydrogen or an "alkyl group, aryl group or alkylaryl group" having from 1 to 23 carbon atoms.

2. The lubricating oil composition according to claim 1 wherein the lubricating oil base oil (A) comprises at least one selected from the group consisting of:

(A1) mixed mineral oil base oils the kinematic viscosity of which at 100° C. is in the range of from 1.4 to 6 $mm^2/s$, (A2) polyalphaolefins, alphaolefin oligomers or mixtures thereof the kinematic viscosity of which at 100° C. is in the range of from 2 to 8 $mm^2/s$, (A3) hindered esters, diesters or mixtures thereof the kinematic viscosity of which at 100° C. is in the range of from 1.4 to 12 $mm^2/s$ and (A4) lubricating oil base oils the kinematic viscosity of which at 100° C. is in the range of from 7 to 50 $mm^2/s$.

3. The lubricating oil composition according to claim 1 further comprising at least one additive selected from the group consisting of metallic detergents, ashless dispersants, zinc dialkyldithiophosphates, rust preventatives, metal deactivators, viscosity index improvers, pour point depressants and defoamers.

4. The lubricating oil composition according to claim 2 wherein the lubricating base oil comprises (A1), and wherein (A1) is selected from the group consisting of a Group II base oil, a Group III base oil, and a mixture thereof.

5. The lubricating oil composition according to claim 2 wherein the lubricating base oil comprises (A4), and wherein (A4) is selected from the group consisting of a Group I base oil, a Group II base oil, a Group III base oil, a Group IV base oil, and a mixture thereof.

6. The lubricating oil composition according to claim 1 wherein the molybdenum dialkyldithiocarbamate is present in an amount from 300 to 1800 ppm in terms of molybdenum.

7. The lubricating oil composition according to claim 1 wherein the tetrabenzyl thiuram disulphide is present in an amount from 50 to 350 ppm in terms of sulphur.

8. The lubricating oil composition according to claim 1 wherein the amine is present in an amount from 0.05 to 2.0 mass %.

9. A method comprising:

applying a lubricating oil composition to a surface in relative movement to another surface, wherein the lubricating oil composition comprises:

(a) a lubricating oil base oil the kinematic viscosity of which at 100° C. is in the range of from 1.4 to 6 $mm^2/s$, (b) from 250 to 2000 ppm in terms of molybdenum of a molybdenum dialkyldithiocarbamate as expressed by the undermentioned Formula (1), (1)

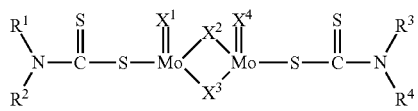

wherein in Formula (1), $R^1$ to $R^4$ denote alkyl groups, and $X^1$ to $X^4$ denote oxygen atoms or sulphur atoms, (c) 20 to 500 ppm in terms of sulphur of tetrabenzyl thiuram disulphide as expressed by the undermentioned Formula (2)

(2)

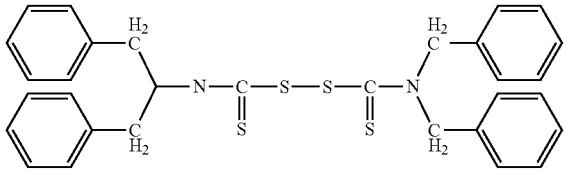

and (d) 0.05 to 3.0 mass % of an amine as expressed by the undermentioned Formula (3) Formula (4), or a mixture thereof, (3)

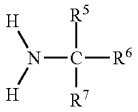

wherein in Formula (3), $R^5$ to $R^7$ denote, each independently, hydrogen or an "alkyl group, aryl group or alkylaryl group" having from 1 to 23 carbon atoms, and (4)

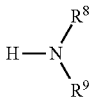

wherein in Formula (4), $R^8$ and $R^9$ denote, each independently, hydrogen or an "alkyl group, aryl group or alkylaryl group" having from 1 to 23 carbon atoms.

10. The method of claim 9 wherein the surface is in an internal combustion engine.

11. The method of claim 9 wherein the lubricating oil base oil (A) comprises at least one selected from the group consisting of:

(A1) mixed mineral oil base oils the kinematic viscosity of which at 100° C. is in the range of from 1.4 to 6 $mm^2/s$, (A2) polyalphaolefins, alphaolefin oligomers or mixtures thereof the kinematic viscosity of which at 100° C. is in the range of from 2 to 8 $mm^2/s$, (A3) hindered esters, diesters or mixtures thereof the kinematic viscosity of which at 100° C. is in the range of from 1.4 to 12 $mm^2/s$ and (A4) lubricating oil base oils the kinematic viscosity of which at 100° C. is in the range of from 7 to 50 $mm^2/s$.

12. The method of claim 9 wherein the lubricating oil composition further comprises at least one additive selected from the group consisting of metallic detergents, ashless dispersants, zinc dialkyldithiophosphates, rust preventatives, metal deactivators, viscosity index improvers, pour point depressants and defoamers.

13. The method of claim 11 wherein the lubricating oil base oil comprises (A1), and wherein (A1) is selected from the group consisting of a Group II base oil, a Group III base oil, and a mixture thereof.

14. The method of claim 11 wherein the lubricating oil base oil comprises (A4), and wherein (A4) is selected from the group consisting of a Group I base oil, a Group II base oil, a Group III base oil, a Group IV base oil, and a mixture thereof.

15. The method of claim 9 wherein the molybdenum dialkyldithiocarbamate is present in an amount from 300 to 1800 ppm in terms of molybdenum.

16. The method of claim 9 wherein the tetrabenzyl thiuram disulphide is present in an amount from 50 to 350 ppm in terms of sulphur.

17. The method of claim 9 wherein the amine is present in an amount from 0.05 to 2.0 mass %.

* * * * *